United States Patent [19]

Inaba et al.

[11] 4,022,023

[45] May 10, 1977

[54] HYDRAULIC CIRCUIT FOR CONTROLLING ACTUATORS IN A CONSTRUCTION VEHICLE

[75] Inventors: Nobuaki Inaba, Hiratsuka; Kenzo Hoashi, Yokohama, both of Japan

[73] Assignee: Kabushiki Kaisha Komatsu Seisakusho, Tokyo, Japan

[22] Filed: Dec. 5, 1975

[21] Appl. No.: 638,070

[30] Foreign Application Priority Data

Aug. 27, 1974 Japan ..... 49-101806

[52] U.S. Cl. ..... 60/445; 60/449; 60/468; 60/484

[51] Int. Cl.[2] ..... F16H 39/46

[58] Field of Search ..... 60/428, 430, 444, 445, 60/449, 486, 493, 468, 484; 417/212, 213

[56] References Cited

UNITED STATES PATENTS

| | | | |
|---|---|---|---|
| 3,543,508 | 12/1970 | Schwab | 60/449 |
| 3,785,754 | 1/1974 | Miller | 60/449 X |

*Primary Examiner*—Edgar W. Geoghegan
*Attorney, Agent, or Firm*—Armstrong, Nikaido & Marmelstein

[57] ABSTRACT

A hydraulic circuit for controlling actuators in a construction vehicle which comprises an engine, a fixed displacement pump driven by said engine, a variable displacement pump driven by said engine, a controlling cylinder connected to the variable displacement pump for controlling the displacement thereof, an orifice provided between the output of the fixed displacement pump and a tank and, an unloading valve connected to the fixed displacement pump and also to the variable displacement pump via a pilot line for selectively unloading an output fluid from the fixed displacement pump when it is open.

1 Claim, 1 Drawing Figure

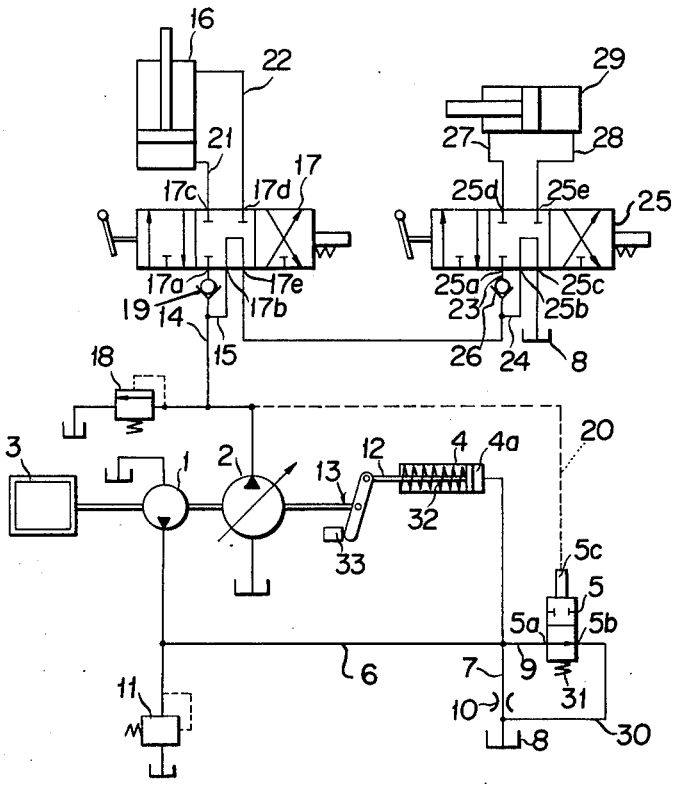
16
22
29
21
27
28
17
17c
17d
25d
25e
25
17a
17e
25a
25c
19
14
17b
23
25b
15
26
24
8
18
20
3
1
2
12
4
4a
13
32
33
5c
5
5a
5b
6
7
9
31
11
10
8
30

HYDRAULIC CIRCUIT FOR CONTROLLING ACTUATORS IN A CONSTRUCTION VEHICLE

This invention relates to a hydraulic circuit for controlling actuators in a construction vehicle such as bulldozer, power shovel and the like.

Heretofore, only a fixed displacement pump has been used for a hydraulic circuit for controlling actuators in a construction vehicle of the type described above.

Since only a fixed displacement pump is used in the hydraulic circuit, a maximum hydraulic fluid is introduced in the circuit even when the actuators are not actuated.

This results in a power loss of the pump, and further the engine is sometimes brought to stop when it is subjected to overloads because the engine is connected through only a fixed displacement pump to the actuators.

It is, therefore, an object of the present invention to provide a hydraulic circuit for controlling actuators in which a power loss of the pumps is significantly minimized when respective control valves for the actuators are all in their respective neutral positions.

It is an another object of the present invention to provide a hydraulic circuit for controlling actuators in which a volumetric output of the pump is variable in proportion to rotational frequency of the engine when the actuators are actuated.

Other objects, features and advantages of the present invention will be readily apparent from the following description taken in conjunction with the following drawing, in which;

The drawing shows a hydraulic circuit for controlling actuators of the present invention.

In the drawing, designated at 1 is a fixed displacement pump and at 2 a variable displacement pump, both pumps being driven by an engine or a prime mover 3. Designated by 4 is a controlling cylinder and by 5 an unloading valve. The fixed displacement pump 1 is provided with an exit or outlet port which is connected through a first pilot line 6 to a head 4*a* of the controlling cylinder 4. Further, the fixed displacement pump 1 is connected through a drain line 7 to a tank 8 and also connected through a bypass line 9 to a port 5*a* of the unloading valve 5. On the lines 7 and 6 are mounted an orifice 10 and a relief valve 11, respectively. The controlling cylinder 4 is provided with a rod 12 which is connected to a means for actuating a swash plate of the variable displacement pump 2. The variable displacement pump 2 is connected at an exit or outlet port thereof through lines 14 and 15 to ports 17*a* and 17*b* of a directional control valve 17 for an actuator 16 in a construction vehicle, respectively. Disposed on the pipe 14 are a high pressure relief valve 18 and a check valve 19. Further, the variable displacement pump 2 is provided at an outlet side thereof with a second pilot line 20 which is connected to an actuating means 5*c* of the unloading valve 5. Ports 17*c* and 17*d* of the directional control valve 17 are connected to head and rod portions of the actuator 16 of the construction vehicle through pipes 21 and 22, respectively. The directional control valve 17 is further provided with a port 17*e* which is connected to ports 25*a* and 25*b* of directional control valve 25 through pipes 23 and 24, respectively. In the pipe 23 is provided a check valve 26. The directional control valve 25 is connected at a port 25*c* thereof to the tank 8 and also connected at ports 25*d* and 25*e* rod and head portions, respectively, of an actuator 29 through pipes 27 and 28, respectively. Further, the aforementioned unloading valve 5 is communicated at the port 5*b* with the tank 8 through a bypass line 30.

When the construction vehicle is not operated, that is, the directional control valves 17 and 25 are respectively in neutral position so that the actuators 16 and 29 are not actuated, the pressure in the pilot line 20 is low, therefore the unloading valve 5 remains open by the action of a spring 31. This allows the fixed displacement pump 1 to be unloaded irrespective of the orifice 10. Accordingly, the rod 12 of the controlling cylinder 4 is pushed toward the right direction by means of a spring 32 and is stopped by a stopper 33, upon which only a small quantity of oil is discharged from the variable displacement pump 2.

When the control valve 17 is operated to allow the actuator 16 to be worked, the pressure at the outlet port of the variable displacement pump 2 is raised. Then, the output pressure of the pump 2 is applied to the unloading valve 5 through the pilot pipe 20 to close the valve 5. When the valve 5 closes, the oil flowing from the fixed displacement pump 1 passes through the orifice 10. The volumetric output of the fixed displacement pump 1 is determined in accordance with a rotational frequency of the prime mover and hence a differential pressure is induced in the orifice by appropriately changing the rotational frequency of the prime mover. The induced pressure is applied to the head 4*a* of the controlling cylinder 4 to permit the rod 12 to move forward against the force of the spring 32, and therefore the swash plate is inclined through the actuating means 13, thereby increasing the volumetric output of the variable displacement pump 2.

When an overload is put on the actuator 16, the rotational frequency of the prime mover is reduced, decreasing the volumetric output of the fixed displacement pump 1. Accordingly, the differential pressure in the orifice 10 is decreased and then the rod 12 of the controlling cylinder 4 is moved toward the right direction by means of the spring 32, so that the swash plate is inclined in such a direction as to reduce the volumetric output of the variable displacement pump 2.

While the volumetric output of the variable displacement pump 2 is thus reduced, the output pressure of the pump 2 can remain unchanged or increase slightly so as to provide the force required for accomplishment of the work by the actuator. Since the overload is thus controlled by the adjustment of the volumetric output of the variable displacement pump 2, the prime mover is not brought to stop even when it is subjected to overloads such reduction since there still exists a pressure in the orifice.

When the actuator 16 is stopped by allowing the directional control valve 17 to move to its neutral position, the hydraulic circuit is unloaded, the output pressure of the variable displacement pump 2 being made equal to its unloading pressure. Thus, the pressure in the pilot line 20 disappears and the unloading valve 5 is opened by the action of the spring 31. Therefore, the hydraulic fluid flow from the fixed displacement pump 1 is drained through the unload valve 5 to the tank 8 without passing through the orifice 10. Under this condition any pressure is no longer applied to the controlling cylinder 4.

As will be understood from the above, the present invention contemplates to provide a hydraulic circuit for controlling actuators in a construction vehicle, which comprises a fixed displacement pump 1 driven by a prime mover 3, a variable displacement pump 2 driven by the prime mover 3 and provided with an outlet port which is connected to a control valve 17 of the actuator, an orifice 10 disposed at an outlet port of the fixed displacement pump 1, and a controlling cylinder means operated by a differential pressure of the orifice 10 and by a spring 32 to suitably control the swash plate of the variable displacement pump.

In the hydraulic circuit of the construction mentioned above, the output pressure of the variable displacement pump 2 is used as a pilot pressure to unload the output pressure of the fixed displacement pump 1, or an unloading valve 5 is connected to the fixed displacement pump 1 and also to the orifice 10, so that the inclination of the swash plate is suitably controlled by changing the rotational frequency of the prime mover which is changed by a load put thereon. By this, a power loss when the directional control valves 17 and 25 are respectively in neutral position can be reduced and the rotational frequency of the prime mover or the volumetric output of the variable displacement pump 2 can be arbitrarily changed when the construction vehicle is run.

What is claimed is:

1. In a hydraulic circuit system for controlling actuators in a construction vehicle which includes:

a prime mover;

a fixed displacement pump driven by said prime mover;

a variable displacement pump driven by said prime mover and connected at the outlet side thereof to the actuators through their respective directional control valves;

a controlling cylinder means hydraulically connected through a first pilot line to an outlet of said fixed displacement pump and mechanically connected to a swash plate of said variable displacement pump for controlling volumetric output of said variable displacement pump; and a drain line with an orifice connected between said first pilot line and a tank for draining hydraulic fluid from said fixed displacement pump, the improvement comprising:

a. a bypass line, one end thereof being connected to said first pilot line and the other end thereof being connected to said drain line downstream from the orifice;

b. an unloading valve means provided in said bypass line for selectively unloading the output pressure of said fixed displacement pump when the unloading valve means is in an open state; and c. a second pilot line, one end thereof being connected to said output line for said variable displacement pump and the other end thereof being connected to an actuating means of said unloading valve means for selectively operating the actuating means of said unloading valve means in response to the variation of the output pressure of said variable displacement pump, whereby said prime mover is prevented from stalling upon an overloading condition of said actuators and whereby power loss of both pumps is significantly minimized when said directional control valves are respectively in neutral positions so that the actuators are not actuated.

* * * * *